United States Patent [19]

Idenawa

[11] Patent Number: 4,896,871

[45] Date of Patent: Jan. 30, 1990

[54] SHEET FEEDER FOR AN IMAGE RECORDING APPARATUS

[75] Inventor: Hiroyuki Idenawa, Hiratsuka, Japan

[73] Assignee: Ricoh Company, Ltd., Tokyo, Japan

[21] Appl. No.: 282,070

[22] Filed: Dec. 9, 1988

[30] Foreign Application Priority Data

Dec. 11, 1987 [JP] Japan ..... 62-188629[U]

[51] Int. Cl.[4] ..... B65H 3/06; B65H 3/44

[52] U.S. Cl. ..... 271/9; 271/121; 271/127

[58] Field of Search ..... 271/9, 117, 121, 124, 271/125, 126, 127

[56] References Cited

U.S. PATENT DOCUMENTS 4,429,863 2/1984 Itoh ..... 271/9

OTHER PUBLICATIONS

IBM Technical Disclosure Bulletin, vol. 17, No. 4, p. 958, Sep. 1974, "Priority Insertion Card Mechanism", R. E. Hunt.

*Primary Examiner*—Richard A. Schacher

*Attorney, Agent, or Firm*—Oblon, Spivak, McClelland, Maier & Neustadt

[57] ABSTRACT

A sheet feeder for a laser printer or similar image recording apparatus which is selectively operable in an automatic sheet feed mode and a manual sheet feed mode includes a manual feed guide plate which is located above a feed tray or a cassette. A presser member is mounted on the guide plate to be movable between an operative position where its front end portion intervenes between a feed roller and a friction pad and an inoperative position where it does not do so. When the presser member is moved toward the feed roller until its front end portion intervenes between the feed roller and the friction pad, the friction pad is physically separated from the feed roller and, instead, the front end portion of the presser member is brought into pressing contact with the feed roller. In this condition, a paper sheet inserted by hand on and along the manual feed guide plate is pressed against the feed roller by the presser member and fed stably by the rotation of the feed roller.

3 Claims, 5 Drawing Sheets

SHEET FEEDER FOR AN IMAGE RECORDING APPARATUS

BACKGROUND OF THE INVENTION

The present invention relates to a sheet feeder applicable to a laser printer, facsimile apparatus, electrophotographic copier or similar image recording apparatus and having an automatic sheet feeding function for feeding paper sheets one by one from a sheet feed tray or a sheet cassette by using a friction pad and a manual sheet feeding function for feeding paper sheets which are manually inserted one at a time.

In a prior art sheet feeder of the type described, manual feed is impracticable unless a release lever is operated every time a paper sheet is fed manually so as to cancel a force which constantly urges the bottom plate of a sheet feed tray. Hence, manual feed cannot be repeated without forcing an operator to withstand troublesome manipulations. In addition, even in a manual feed mode, a friction pad is held in pressing contact with a feed roller and therefore exerts a pressure on a paper sheet to be fed, rendering the sheet feeding force unstable.

SUMMARY OF THE INVENTION

It is therefore an object of the present invention to provide a sheet feeder for an image recording apparatus which enhances efficient manipulations when operated in a manual sheet feed mode.

It is another object of the present invention to provide a sheet feeder for an image recording apparatus which promotes stable sheet feed.

It is another object of the present invention to provide a generally improved sheet feeder for an image recording apparatus.

A sheet feeder for an image recording apparatus having an automatic sheet feeding function for automatically feeding paper sheets one by one from sheet loading means and a manual sheet feeding function for feeding paper sheets which are manually inserted one at a time of the present invention comprises a feed roller member for feeding the paper sheets one by one from the sheet loading means, a friction pad member pressed against the feed roller member when the feed roller feeds the paper sheet so as to separate the paper sheets one by one, a manual feed guide member located above the sheet loading means for guiding the paper sheet when the manual sheet feeding function is effected, and a presser member mounted on the manual feed guide member to be movable between an operative position where one end portion of the presser member intervenes between the feed roller member and the friction pad member and an inoperative position where the one end portion does not intervene between the feed roller member and the friction pad member.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
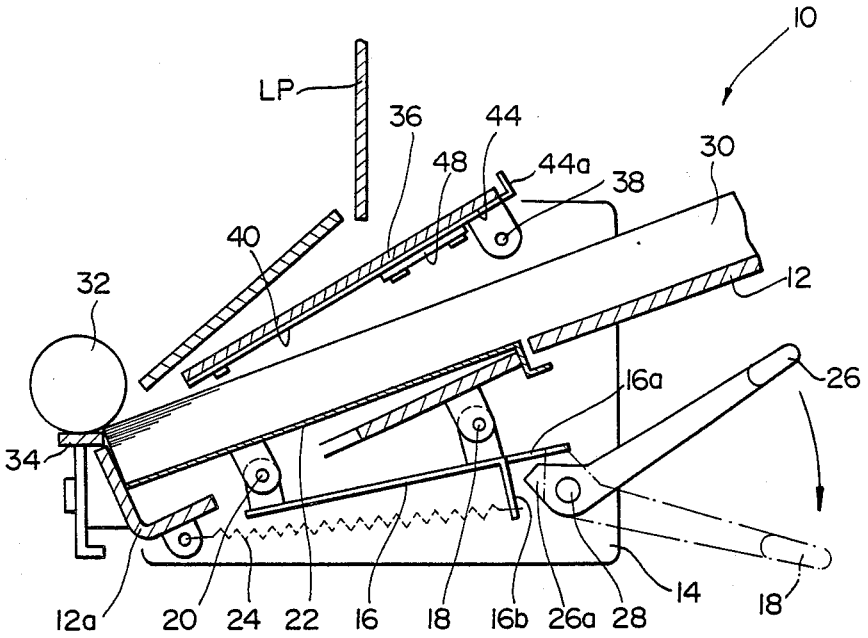
FIG. 1 is a section showing a sheet feeder embodying the present invention in an automatic feed condition.

Referring to FIGS. 1 to 4 of the drawings, a sheet feeder embodying the present invention is shown and generally designated by the reference numeral 10. As shown, the sheet feeder 10 includes a feed tray 12 which is loaded with a stack of paper sheets and supported at opposite sides thereof by a guide frame 14 in a forwardly downwardly inclined position. A connecting lever 16 is rotatably connected to the underside of the feed tray 12 by a fulcrum 18 and is connected to a bottom plate 22 of the feed tray 12 by a pin 20. A lug 16*b* extends downward from on end portion 16*a* of the lever 16 adjacent to the fulcrum 18. A spring 24 is anchored at one end to the lug 16*b* and at the other end to a front end portion 12*a* of the feed tray 12, whereby the bottom plate 22 is constantly biased upward.

A release lever 26 is rotatably mounted on the guide frame 14 by a fulcrum 28 and includes an end portion 26*a* which is engaged with the end portion 16*a* of the connecting lever 16. Hence, when the release lever 26 is raised about the fulcrum 28 to a position indicated by a solid line in FIG. 1, the tip of papers 30 stacked on the feed tray 12 is pressed against a feed roller 32. A friction pad 34 is is pressed against the feed roller 32 from below by a predetermined pressure which is exerted by a spring, not shown.

As the feed roller 32 is rotated with sheet feeder 10 remaining in the condition shown in FIG. 1, the paper sheets 30 are automatically fed one by one by the friction pad 34 which is pressed against the feed roller 32.

Figure 2:
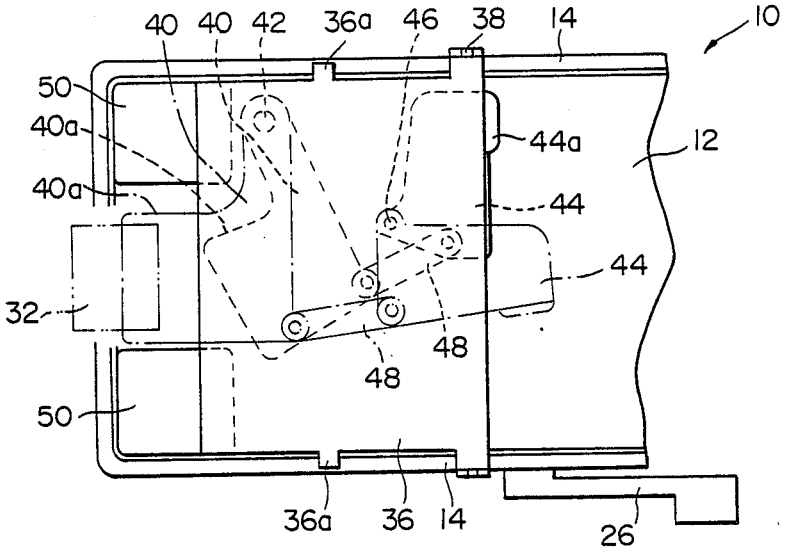
FIG. 2 is a plan view representative of a relationship between a feed tray and a manual feed mechanism which are included in the sheet feeder of FIG. 1.

A manual feed guide plate 36 is located above the feed tray 12 and pivotally mounted at its rear opposite sides to the top of the opposite sides of the guide frame 14 to be rotatable up and down about a fulcrum 38. More specifically, as shown in FIG. 2, the manual feed guide plate 36 is provided with projections 36*a* at the intermediate points of its opposite side edges which are individually engaged with the inclined top of the opposite sides of the guide frame 14. The guide plate 36 is held in a forwardly downwardly inclined position on the guide frame 14 by gravity. As shown in FIG. 2, a flat presser member 40 is rotatably mounted on the underside of the manual feed guide plate 36 by a fulcrum 42. Also mounted on the underside of the guide plate 36 is a flat manual feed lever 44 which is rotatable about a fulcrum 46. The presser member 40 is provided at its free end with a projection 40*a* having substantially the same widthwise dimension as the feed roller 32. The manual feed lever 44 is provided at its free end with a thumb piece 44*a* which protrudes upward from the rear edge of the manual feed guide plate 36. The presser member 40 and guide plate 36 are operatively connected to each other by a link 48.

Figure 3:
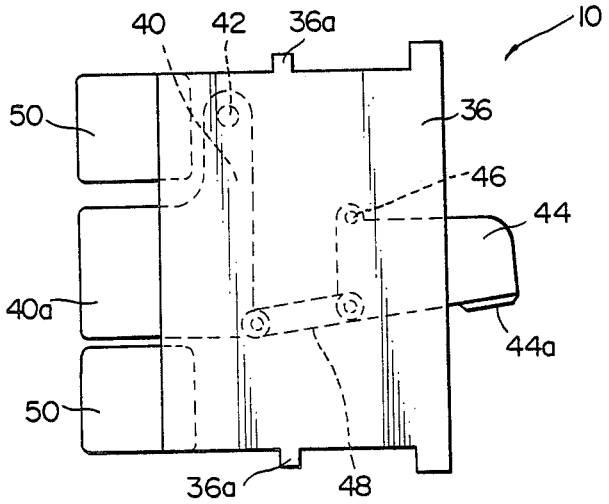
FIG. 3 is a plan view of the manual feed mechanism shown in FIG. 2.
Figure 4:
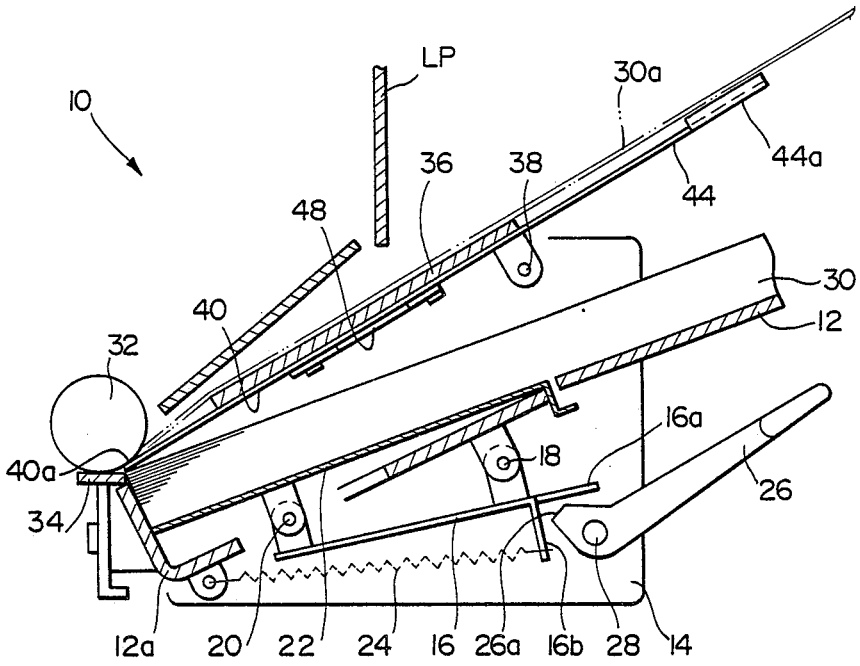
FIG. 4 is a section showing the sheet feeder of FIG. 1 in a manual feed condition.

When the manual feed lever 44 is held in a closed position relative to the manual feed guide plate 36 as indicated by a solid line in FIG. 2, the presser member 40 is maintained in an inoperative position which is remote from the feed roller 32. As the manual feed lever 44 is sequentially moved from the closed position to an open position indicated by a dash-and-dot line in the figure, the presser member 40 interlocked with the lever 44 is rotated about the fulcrum 42 until its projection 40*a* is brought to between a pair of spaced paper guides 50, as shown in FIG. 3. The paper guides 50 are provided at front opposite sides of the manual feed guide plate 36 and implemented by elastic sheets such as polyester films. Further, as shown in FIG. 4, the projection 40*a* reaches a position between the feed roller 32 and the friction pad 34, i.e., operative position where it physically separates the friction pad 34 and the paper sheets 30 on the feed tray 12 from the feed roller 32. In this condition, when a paper sheet 30*a* is fed by hand on and along the upper surface of the manual feed guide plate 36, the leading edge of the paper sheet 30*a* is guided onto the projection 40*a* of the presser member 40 and pressed against the feed roller 32 by the force of the friction pad 34 via the projection 40*a*. As the feed roller 32 is driven in a rotary motion, it feeds only the paper sheet 30*a* which is laid on the manual feed guide plate 36. The presser member 40 may advantageously be implemented by wear-resisting metal having a small coefficient of friction.

Figure 5:
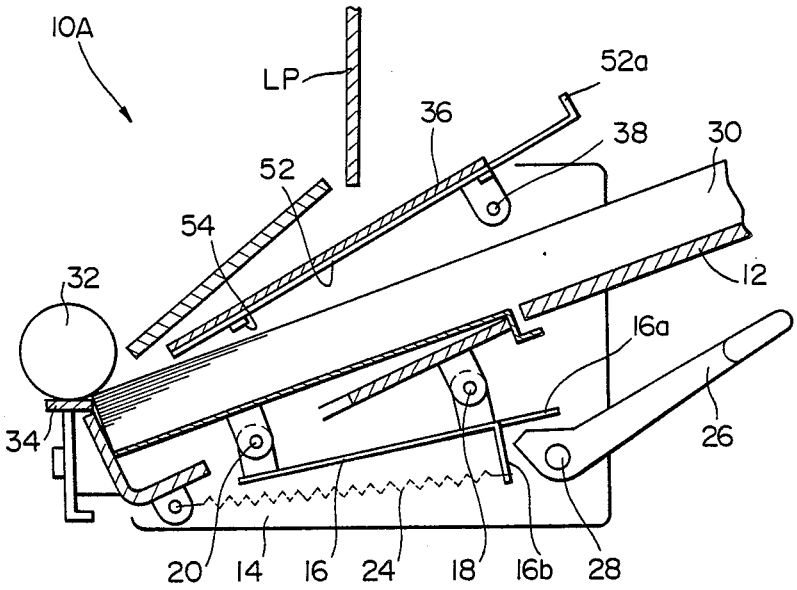
FIG. 5 is a section showing an alternative embodiment of the present invention in an automatic feed condition.
Figure 6:
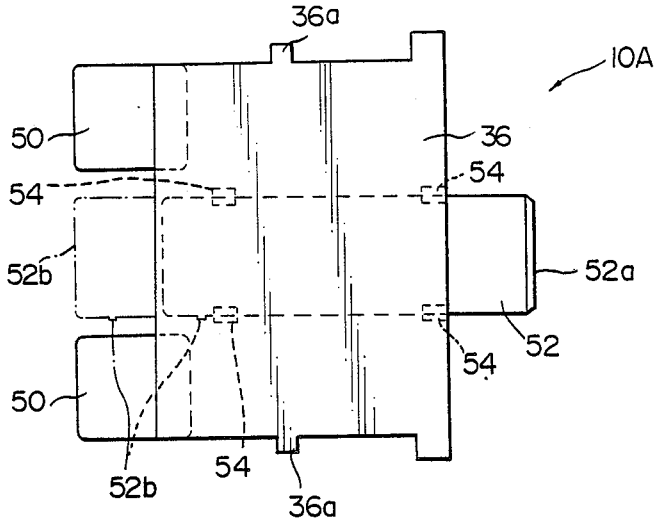
FIG. 6 is a plan view of a manual feed mechanism included in the sheet feeder of FIG. 5.
Figure 7:
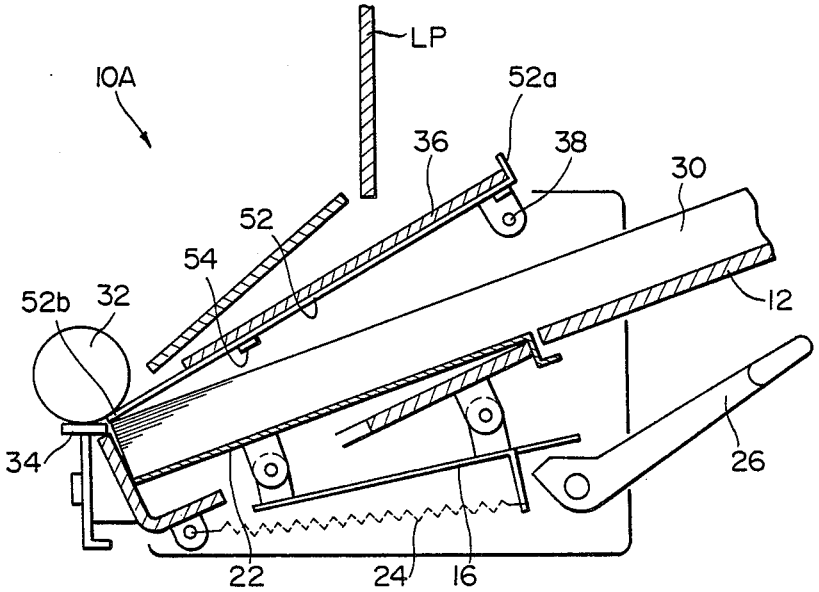
FIG. 7 is a section showing the sheet feeder of FIG. 5 in a manual feed condition.

Referring to FIGS. 5 to 7, an alternative embodiment of the present invention is shown. In the figures, the same or similar structural parts and elements as those shown in FIGS. 1 to 4 are designated by like reference numerals, and redundant description thereof will be avoided for simplicity. The sheet feeder, generally 10A, includes a single flat presser member 52 which is mounted on the underside of the manual feed guide plate 36. More specifically, two pairs of generally L-shaped guide pieces 54 are fitted on the underside of the guide plate 36 to hold the presser member 52 such that the presser member 52 is slidable toward and away from the feed roller 32. The presser plate 52 is provided with a generally L-shaped thumb piece 52*a* at its rear end which also serves as a rear stop for abutting against a rear edge of the manual feed guide plate 36. Further, the presser plate 52 is provided with a front stop 52*b* at its one side edge which is engageable with one of the front guide pieces 54 of the guide plate 36.

When the presser member 52 is moved forward from a retracted position indicated by a solid line in FIG. 6 to an advanced position indicated by a dash-and-dot line in the same figure, its front portion 52*b* is brought to between the feed roller 32 and the friction pad 34, as shown in FIG. 7. This separates the friction pad 34 and the paper sheets 30 on the feed tray 12 from the feed roller 32. In this condition, when a paper sheet is inserted by hand along the upper surface of the manual feed guide plate 36, it will be fed in exactly the same manner as discussed in relation to the previous embodiment.

While the foregoing description has concentrated on an automatic sheet feeder of the type using a sheet feed tray, it will be clear that the present invention is similarly applicable even to an automatic sheet feeder which is implemented by a sheet cassette.

In summary, it will be seen that the present invention provides a sheet feeder for an image recording apparatus which promotes efficient manual sheet feed by eliminating the need for the manipulation of a release lever heretofore required after each manual feed. Furthermore, the manual feed attainable with the present invention is stable because a friction pad is separated from a feed roller in a manual feed mode.

Various modifications will become possible for those skilled in the art after receiving the teachings of the present disclosure without departing from the scope thereof.

What is claimed is:

1. A sheet feeder for an image recording apparatus having an automatic sheet feeding function for automatically feeding paper sheets one by one from sheet loading means and a manual sheet feeding function for feeding paper sheets which are manually inserted one at a time, comprising:

a feed roller member for feeding the paper sheets one by one from said sheet loading means;

a friction pad member pressed against said feed roller member when said feed roller feeds the paper sheet so as to separate the paper sheets one by one;

a manual feed guide member located above said sheet loading means for guiding the paper sheet when the manual sheet feeding function is effected; and a presser member mounted on said manual feed guide member to be movable between an operative position where one end portion of said presser member intervenes between said feed roller member and said friction pad member and an inoperative position where said one end portion does not intervene between said feed roller member and said friction pad member.

2. A sheet feeder as claimed in claim 1, wherein said presser member is mounted on said manual feed guide member to be movable between the operative position and the inoperative position by being rotated about a fulcrum which is located at an end portion opposite to said one end portion.

3. A sheet feeder as claimed in claim 1, wherein said presser member is mounted on said manual feed guide member to be slidingly movable between the operative position and the inoperative position by being guided by guide means which is provided on said manual feed guide member.

* * * * *